US009623479B2

(12) United States Patent
O'Malley et al.

(10) Patent No.: US 9,623,479 B2
(45) Date of Patent: Apr. 18, 2017

(54) APPARATUS INCLUDING METAL FOAM AND METHODS FOR USING SAME DOWNHOLE

(75) Inventors: Edward J. O'Malley, Houston, TX (US); Grant R. Thompson, Tulsa, OK (US)

(73) Assignee: BAKER HUGHES INCORPORATED, Houston, TX (US)

( * ) Notice: Subject to any disclaimer, the term of this patent is extended or adjusted under 35 U.S.C. 154(b) by 634 days.

(21) Appl. No.: 13/271,377

(22) Filed: Oct. 12, 2011

(65) Prior Publication Data

US 2012/0090830 A1 Apr. 19, 2012

Related U.S. Application Data

(60) Provisional application No. 61/393,610, filed on Oct. 15, 2010.

(51) Int. Cl.
*E21B 33/12* (2006.01)
*E21B 33/128* (2006.01)
*B22D 25/00* (2006.01)

(52) U.S. Cl.
CPC ..... *B22D 25/005* (2013.01); *E21B 33/1208* (2013.01); *E21B 33/128* (2013.01)

(58) Field of Classification Search
CPC ..... E21B 33/1208; E21B 33/1212; E21B 2033/005; E21B 33/128
USPC ..... 166/135, 292, 192, 386, 381, 387; 164/79; 285/381.2, 381.3
See application file for complete search history.

(56) References Cited

U.S. PATENT DOCUMENTS

| | | | | |
|---|---|---|---|---|
| 4,424,865 | A * | 1/1984 | Payton, Jr. | 166/302 |
| 4,844,413 | A | 7/1989 | Weber et al. | |
| 5,163,692 | A | 11/1992 | Schofield et al. | |
| 5,426,264 | A * | 6/1995 | Livingston et al. | 174/102 R |
| 6,422,010 | B1 * | 7/2002 | Julien | 60/527 |
| 7,743,825 | B2 | 6/2010 | O'Malley et al. | |
| 2005/0092957 | A1 | 5/2005 | Headings et al. | |
| 2007/0240877 | A1 * | 10/2007 | O'Malley et al. | 166/179 |
| 2009/0255675 | A1 * | 10/2009 | Casciaro | 166/292 |
| 2010/0006303 | A1 | 1/2010 | Garcia et al. | |
| 2010/0018700 | A1 | 1/2010 | Hill, Jr. et al. | |

FOREIGN PATENT DOCUMENTS

| | | | |
|---|---|---|---|
| EP | 0521667 | A1 | 1/1993 |
| EP | 0802302 | A1 | 10/1997 |

OTHER PUBLICATIONS

Low Temperature Properties of Polymers, 2005, Zeus Industrial Products, Inc., p. 3.*
Excerpt—DuPont Tefzel—Properties Handbook, Nov. 2003, DuPont, p. 13.*
International Search Report and the Written Opinion of the International Searching Authority, or the Declaration for International Application No. PCT/US2011/056131: all references are cited above.

* cited by examiner

*Primary Examiner* — George Gray
(74) *Attorney, Agent, or Firm* — Cantor Colburn LLP

(57) ABSTRACT

A device to be deployed downhole. The device includes a member including a metallic foam and a sealing material coupled to the metallic foam. The member attains a compressed shape when compressed to restrict fluid flow between regions downhole. The sealing material may be in, on or coated on the metallic foam member.

14 Claims, 4 Drawing Sheets

APPARATUS INCLUDING METAL FOAM AND METHODS FOR USING SAME DOWNHOLE

CROSS-REFERENCE TO RELATED APPLICATIONS

This application takes priority from U.S. Provisional Application Ser. No. 61/393,610, filed on Oct. 15, 2010, which is incorporated herein in its entirety by reference.

BACKGROUND OF THE DISCLOSURE

1. Field of the Disclosure

The disclosure relates generally to apparatus using a metallic foam, including sealing devices, such as packers, seals or bridge plugs for use down hole.

2. Description of the Related Art

Hydrocarbons such as oil and gas are recovered from a subterranean formation using a well or wellbore drilled into the formation. In some cases the wellbore is completed by placing a casing along the wellbore length and perforating the casing adjacent each production zone (hydrocarbon bearing zone) to extract fluids (such as oil and gas) from the associated a production zone. In other cases, the wellbore may be open hole, i.e. no casing. In an aspect, one or more inflow control devices are placed in the wellbore to control the flow of fluids into the wellbore. These flow control devices and production zones are generally separated by packers installed between them. Packers prevent flow of fluid between selected wellbore locations. For example, packers are used to prevent other fluids from mixing with hydrocarbons extracted from the formation to improve hydrocarbon production. Fluid from each production zone entering the wellbore is drawn into a tubular that runs to the surface.

Sealing devices, including packers, O-rings, etc. are used in various locations in the wellbore to control fluid flow. During production, the sealing devices are subject to extreme temperatures and pressures downhole. For example, an O-ring used to seal a joint between tubular sections is subjected to high pressure as fluid is extracted from the formation. The high pressure, temperature and other downhole conditions can cause portions of sealing devices to break down or deform over time. Replacing or repairing downhole seals can be costly and time consuming.

SUMMARY

In one aspect, a device is provided that in one configuration includes a member including a metallic foam and a sealing material coupled to the metallic foam. The sealing material may be in, on or coated on the metallic foam member.

In another aspect, a method of making a device to be deployed downhole includes placing a liquid alloy in a mold of a sealing member, placing beads in the liquid alloy and dissolving the beads to form pores in the liquid alloy. The method also includes hardening the liquid alloy to form a metallic foam sealing member and coupling a sealing material to the metallic foam sealing member.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters designate like or similar elements throughout the several figures of the drawing, and wherein.

DETAILED DESCRIPTION OF THE DISCLOSURE

The present disclosure relates to apparatus and methods for controlling flow of formation fluids in a well. The present disclosure provides certain exemplary drawings to describe certain embodiments of the apparatus and methods that are to be considered exemplification of the principles described herein and are not intended to limit the concepts and disclosure to the illustrated and described embodiments.

Figure 1:
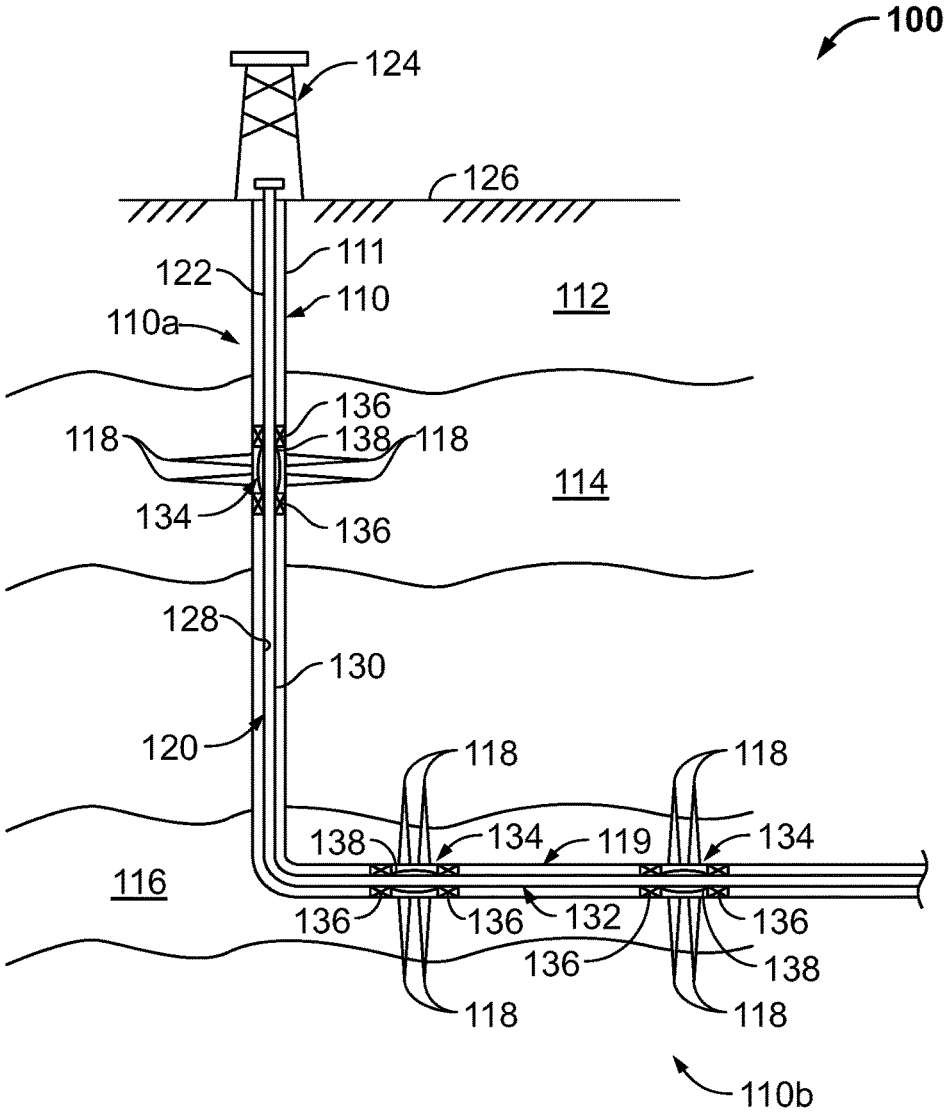
FIG. 1 is a schematic elevation view of an exemplary multi-zone wellbore that has a production string installed therein, which production string includes one or more sealing devices according to an embodiment of the disclosure.

Referring initially to FIG. 1, there is shown an exemplary production wellbore system 100 that includes a wellbore 110 drilled through an earth formation 112 and into a pair of production zones or reservoirs 114, 116. The wellbore 110 is shown lined with a casing having a number of perforations 118 that penetrate and extend into the formations production zones 114, 116 so that production fluids may flow from the production zones 114, 116 into the wellbore 110. The exemplary wellbore 110 is shown to include a vertical section 110*a* and a substantially horizontal section 110*b*. The wellbore 110 includes a production string (or production assembly) 120 that includes a tubing (also referred to as the tubular or base pipe) 122 that extends downwardly from a wellhead 124 at the surface 126 of the wellbore 110. The production string 120 defines an internal axial bore 128 along its length. An annulus 130 is defined between the production string 120 and the wellbore casing. The production string 120 is shown to include a generally horizontal portion 132 that extends along the deviated leg or section 110*b* of the wellbore 110. Production devices 134 are positioned at selected locations along the production string 120. Optionally, each production device 134 may be isolated within the wellbore 110 by a pair of packer devices 136. Although only two production devices 134 are shown along the horizontal portion 132, a large number of such production devices may be arranged along the horizontal portion 132.

Each production device 134 includes a downhole-adjustable flow control device 138 made according to one embodiment of the disclosure to govern one or more aspects of flow of one or more fluids from the production zones into the production string 120. The downhole-adjustable flow control device 138 may have a number of alternative structural features that provide selective operation and controlled fluid flow therethrough. As used herein, the term "fluid" or "fluids" includes liquids, gases, hydrocarbons, multi-phase fluids, mixtures of two of more fluids, water and fluids injected from the surface, such as water. Additionally, references to water should be construed to also include water-based fluids; e.g., brine or salt water.

Subsurface formations typically contain water or brine along with oil and gas. Water may be present below an oil-bearing zone and gas may be present above such a zone. A horizontal wellbore, such as section 110*b*, is typically drilled through a production zone, such as production zone 116, and may extend more than 5,000 feet in length. Once the wellbore has been in production for a period of time, water may flow into some of the production devices 134. The amount and timing of water inflow can vary along the length of the production zone. It is desirable to position packer devices 136 in various locations throughout the wellbore to control flow of unwanted fluids and/or to alter the flow of fluids into the production string 120. As discussed below with reference to FIGS. 2-4, sealing devices, such as packer devices 136 and O-rings, are provided herein that are capable of withstanding downhole conditions over time while controlling fluid flow in the wellbore 110. For example, packer device 136 comprises a metallic foam and a sealing material, wherein the metallic foam is a frame member covered by the sealing material providing the packer device withstand pressures of up to about 30,000 psi and temperatures up to 200 degrees Celsius while controlling flow of fluids from selected production zones. Accordingly, sealing devices are provided that are durable and robust to improve control of fluid flow in the wellbore 110 while reducing or eliminating maintenance. As discussed herein, sealing describes the characteristic of preventing or restricting fluid flow from one area or region to another.

Figure 2:
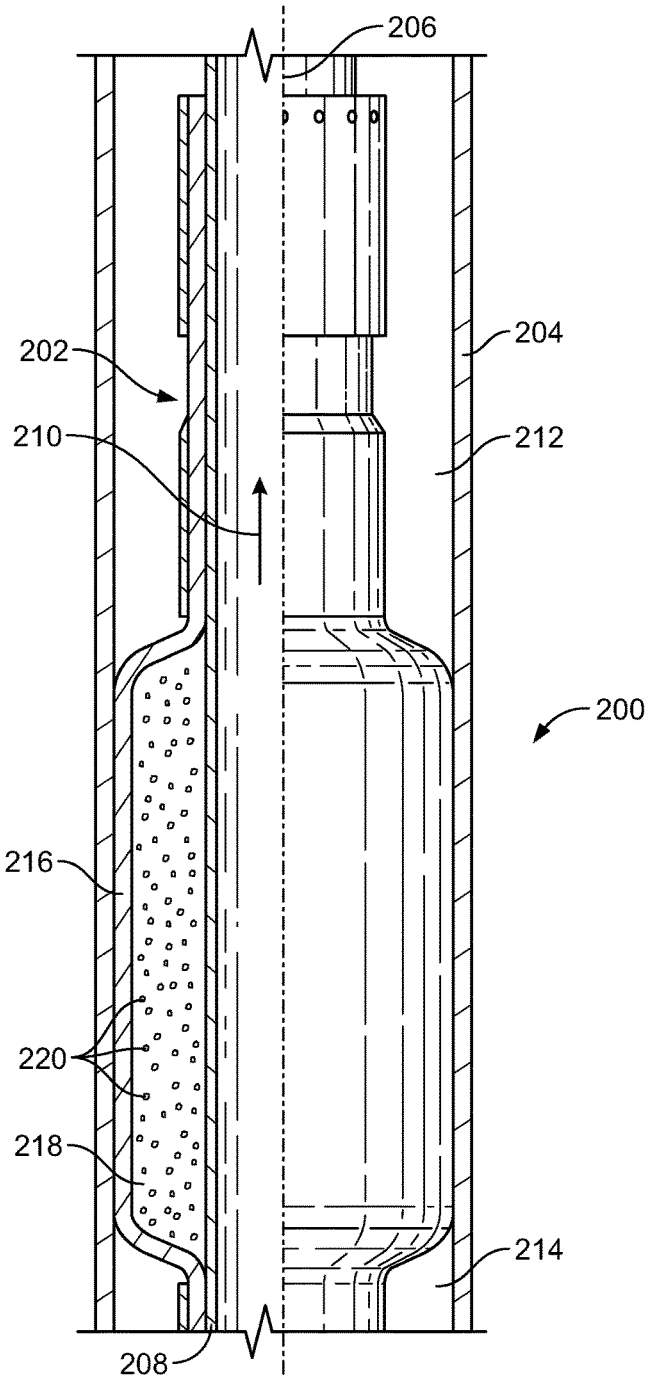
FIG. 2 shows a side view of a packing device according to one embodiment the disclosure.

FIG. 2 is a side view of a packing device or packer 200 coupled to a production string 202. As depicted, the packer 200 and production string 202 are disposed in a casing 204 located within a wellbore (110 of FIG. 1). The packer 200, production string 202 and casing 204 share longitudinal axis 206. The production string 202 includes a tubular 208 configured to direct production fluid flow 210 to the surface. The packer 200 provides a seal with casing 204, thereby preventing fluid communication between uphole region 212 and downhole region 214. In an aspect, the packer 200 comprises a sealing material 216 and metallic foam 218. In an embodiment, the sealing material 216 is coupled to the metallic foam 218, thereby coating the exterior of the metallic foam 218 and filling pores 220 within the metallic foam 218.

In an exemplary embodiment, the metallic foam 218 forms a frame or support member, wherein the metallic foam 218 comprises a shape memory alloy ("SMA") with a plurality of pores. The metallic foam 218 frame is formed by pouring heated liquid or molten SMA into a mold of a desired volume, where the mold contains a network of sacrificial soluble beads or spheres. The beads dissolve as the molten SMA is mixed with the beads or is poured into the mold to create the pores 220, thus producing a metallic foam 218 frame in the shape of the mold. After setting and/or hardening, the metallic foam 218 frame is produced with an amount of pores corresponding to desired structural and sealing properties of the device. In some embodiments, the metallic foam 218 may be formed in a mold and then machined to provide a desired shape. A metallic foam or metal is a cellular structure consisting of a solid metal or metal alloy, containing a volume fraction of gas-filled pores. The pores can be sealed (closed-cell foam), or they can form an interconnected network (open-cell foam). In aspects, metallic foams have a high porosity, such as a metallic foam where 75-95% of the volume consists of void spaces. The strength of foamed metal possesses a relationship that is proportional to its density; i.e., a 20% dense material is more than twice as strong as a 10% dense material. Further, metallic foams typically retain some physical properties of their base material.

In an exemplary embodiment, the metallic foam 218 frame comprises a SMA, wherein the SMA provides support to the packer 200 to withstand extreme temperatures and pressures in the wellbore. The shape memory alloy exhibits pseudoelastic properties of the metal during the high-temperature (austenitic) phase. For example, the exemplary shape memory alloy exhibits pseudoelastic properties at temperatures between about 20 and 200 degrees Celsius. Thus, the metallic foam 218 frame of the packer 200 is made of shape memory alloy enabling the packer to undergo large deformations in its austenitic state when a force or stress is applied and then revert back to their original shape when the stress is removed. In an example, the metallic foam 218 frame may be a first shape when not stressed, a second shape when compressed and revert back to substantially the first shape when the compressive forces are removed. The metallic foam 218 frame will allow compression while minimizing strain across portions of the metallic foam 218. Specifically, in an exemplary embodiment, when the metallic foam 218 frame comprising SMA is compressed about 15% volumetric compression, no single portion of the metallic foam 218 is subjected to more than an average of about 8% strain. Porosity of metal foams in the range of 30 to 80% are useable in this application based on the specific design criteria. A desired feature for this application is that all of the pores are interconnected. Exemplary shape memory alloys include, but are not limited to: Cu—Al—Ni 14/14.5 wt. % Al and 3/4.5 wt. % Ni, Cu—Sn approx. 15 at. % Sn, Cu—Zn 38.5/41.5 wt. % Zn, Cu—Zn—X (X=Si, Al, Sn), Fe—Pt approx. 25 at. % Pt, Mn—Cu 5/35 at. % Cu, Fe—Mn—Si, Pt alloys, Co—Ni—Al, Co—Ni—Ga, Ni—Fe—Ga, Ti—Pd in various concentrations, Ni—Ti (~55% Ni), Ni—Ti—Nb and Ni—Mn—Ga.

In an embodiment, the metallic foam 218 frame is coupled to and/or covered by sealing material 216, wherein the sealing material 216 is a suitable durable material that prevents fluid communication between selected regions, such as regions 212 and 214. In an embodiment, the sealing material 216 couples to the metallic foam 218 member, coating the exterior of metallic foam 218 while substantially filling and impregnating pores 220 in the foam. In another embodiment, the metallic foam 218 has the sealing material 216 disposed in or coupled to the pores 220 to restrict fluid flow across the frame. In embodiments, the sealing material 216 includes elastomers, rubbers and/or polymers that exhibit pseudoelastic properties at downhole temperatures ranging from 20 to 200 degrees Celsius. Examples of sealing material 216 include Natural rubber, Synthetic polyisoprene, Butyl rubber, Halogenated butyl rubbers, Polybutadiene, Styrene-butadiene Rubber, Nitrile rubber, Hydrogenated Nitrile Rubbers (HNBR) Therban and Zetpol, Chloroprene rubber, polychloroprene, Neoprene, Baypren, Ethylene propylene rubber, Epichlorohydrin rubber, Polyacrylic rubber, Silicone rubber, Fluorosilicone Rubber, Fluoroelastomers, Perfluoroelastomers, Polyether block amides, Chlorosulfonated polyethylene, Ethylene-vinyl acetate, Thermoplastic elastomers, Thermoplastic vulcanizates, Thermoplastic polyurethane, Thermoplastic olefins, Proteins resilin and elastin and Polysulfide rubber.

Still referring to FIG. 2, the packer 200 includes metallic foam 218 with selected properties that are suitable for specific downhole applications. For example, for high pressure (e.g., 30,000 psi) environments, a "harder" metallic foam 218 is used, wherein the porosity is reduced and the volume of metal is relatively higher than for a low pressure environment (e.g., about 1,000 psi). The "harder" metallic foam 218 is therefore less elastic than higher porosity metallic foams 218 used in low pressure applications. Less elastic materials may not seal as well as higher elasticity materials. Thus, the mechanical hardness and strength of the metallic foam 218 is balanced against desired sealing properties that are affected by elasticity. In an exemplary embodiment, the desired hardness, strength and elasticity are determined for the downhole application, and the corresponding metallic foam 218 structure is manufactured, wherein the metallic foam has the porosity as well as the percent volume of metal and metal alloy to achieve the desired properties.

Figure 3:
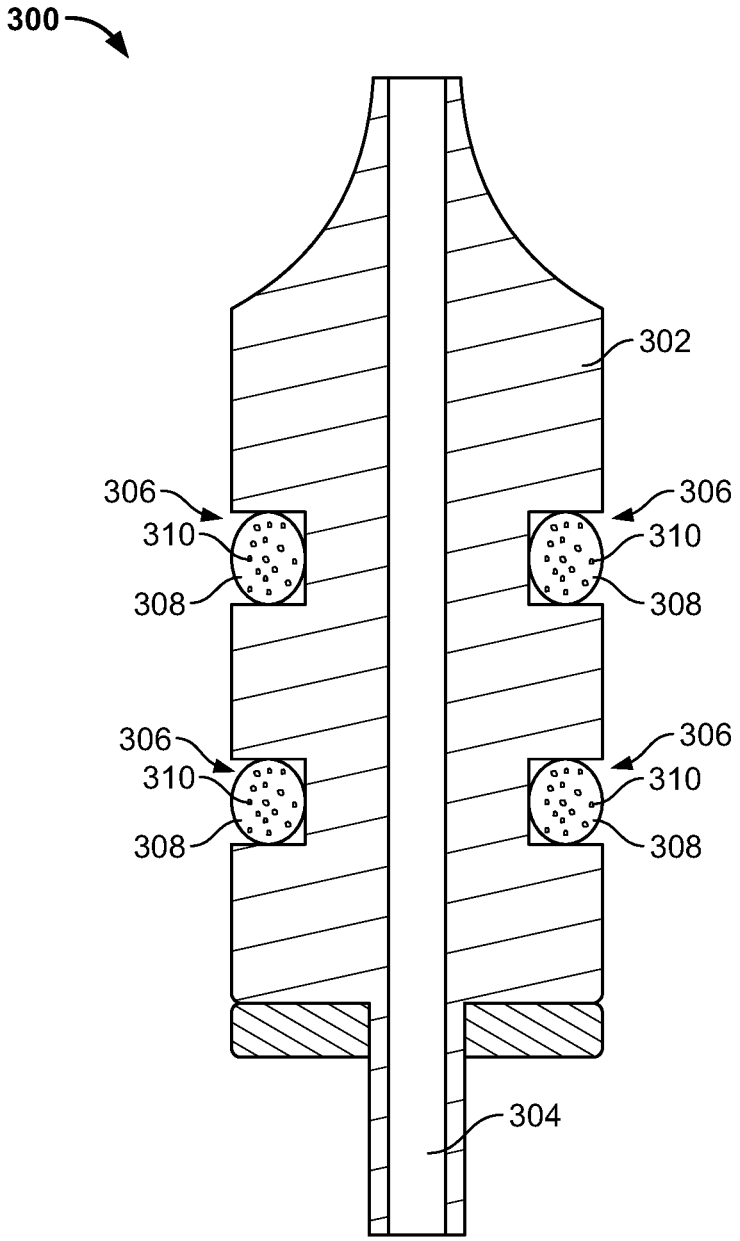
FIG. 3 shows a sectional side view of a portion of a cable assembly including a sealing device according to one embodiment the disclosure.

FIG. 3 is a sectional side view of a portion of a cable assembly 300. The cable assembly 300 is configured to placed in a wellbore and includes a bulkhead 302, conductive wire 304 and sealing devices or O-rings 306. In an embodiment, the cable assembly 300 is placed in a wall of a tubular to pass the conductive wire from within the tubular to an annulus outside of the tubular. The bulkhead 302 and O-rings 306 seal the annulus from inside the tubular, wherein a pressure difference exists between the annulus and tubular. The structure of O-rings 306 provides the ability to withstand downhole pressure and temperature. The O-rings 306 include sealing material 308 coupled to metallic foam 310, wherein the metallic foam 310 reinforces the O-rings 306 to improve durability. The sealing material may coat and/or impregnate the metallic foam 310 to provide sealing properties for the O-rings 306. Metallic foam 310 comprises shape memory alloy that exhibits pseudoelastic properties when deployed downhole. Exemplary metallic foam 310 are listed above with reference to FIG. 2. Further, the sealing material 308 comprises a suitable material for sealing fluids downhole, such as those listed above with reference to FIG. 2.

Figure 4A:
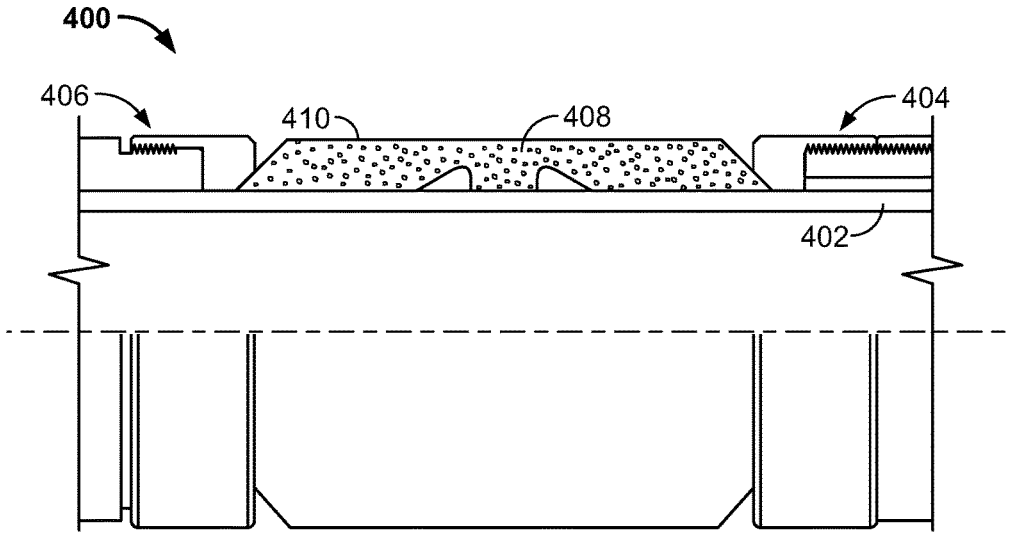
FIGS. 4A and 4B show side views of a packing device according to one embodiment the disclosure.
Figure 4B:
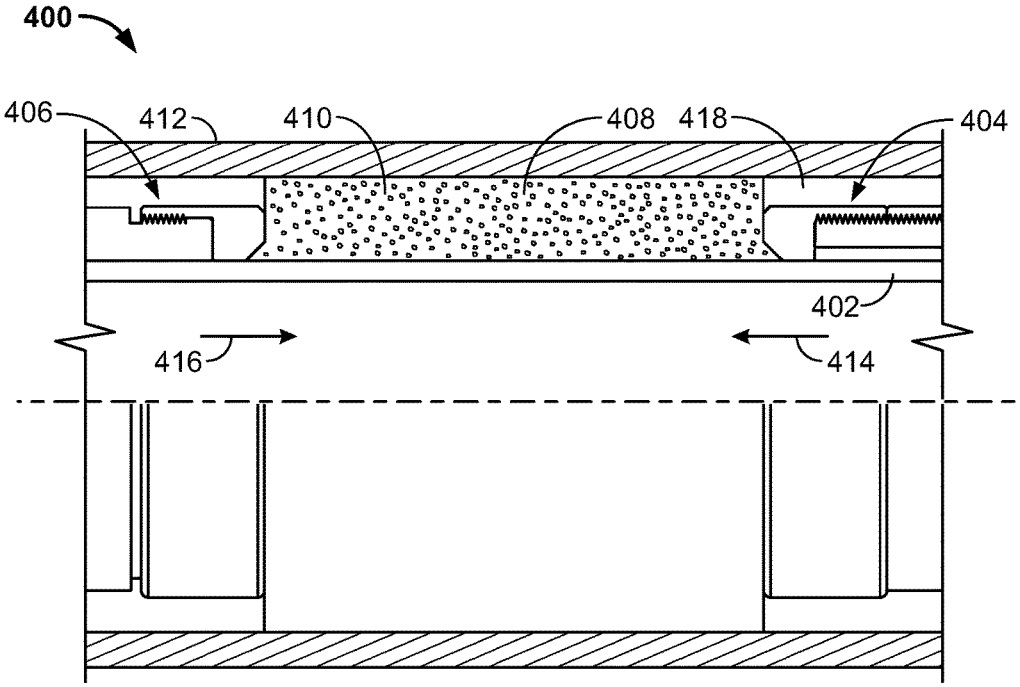

FIGS. 4A and 4B are side views of an exemplary packer 400 as it is being installed in a wellbore. The packer 400 is located on a tubular 402 between a first completion member 404 and a second completion member 406. The packer 400 comprises a metallic foam 408 coupled to a sealing material 410. As depicted in FIG. 4A, the packer 400 is in a run-in state or shape, where the packer 400 is not sealing or controlling a fluid flow downhole. In FIG. 4B, the packer 400 is positioned in a casing 412 and is compressed between first completion member 404 and second completion member 406. The first and second completion members 404 and 406 are activated by a tool or device (not shown) to cause movement in directions 414 and 416, respectively, thereby compressing the packer 400. Accordingly, the compressed packer 400 provides a seal with casing 412 to control a fluid flow in annulus 418 downhole. As depicted, the sealing material 410 impregnates the metallic foam 408 to substantially fill pores in the metallic foam, thereby providing the sealing function for the packer 400.

Thus, in one aspect the disclosure provides a device that includes a first member comprising a metallic foam and a sealing material coupled to the metallic foam. The device may be configured for use in any suitable application, including a device configured for use downhole. In one aspect, the metallic foam may be in a first state when a force is applied to the first member and in a second state when the force is removed from the first member. In another aspect, the metallic foam may be in a pseudoelastic state between a selected temperature range. In one aspect, the temperature range may be between 20 degrees and 250 degrees Celsius. In another aspect, the first member prevents a fluid flow when positioned adjacent to a second member. The second member may be a wellbore while the first member may comprise a packing element configured to prevent flow between regions of the wellbore. The metallic foam includes a plurality of pores within a shape memory alloy. In one configuration, the sealing material impregnates substantially all the plurality of pores. In aspects, the metallic foam comprises a shape memory alloy with elastic properties to allow bulk compression of about 15% of the device while maintaining less than about 8% average strain. In aspects, the sealing material may comprise a polymer that maintains favorable elastic properties within a desired temperature range. In aspect, the temperature range may be between 20 degrees to 250 degrees Celsius.

It should be understood that FIGS. 1-4B are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. A device, comprising:

a member on a tubular of a production string, the member comprising a metallic foam located on the tubular, the metallic foam made of a shape memory alloy having a plurality of gas-filled pores, wherein the metallic foam deforms to a shape that forms the seal and provides support to the seal at a downhole temperature when compressed along the longitudinal axis;

a sealing material covering the metallic foam and filling in the pores of the metallic foam, wherein the sealing material impregnates the pores of the metallic foam as the metallic foam deforms to provide a sealing function of the member; and a first completion member and a second completion member of the production string at opposite ends of the tubular wherein the first completion member and the second completion member move towards each other to compress the metallic foam along the longitudinal axis to deform the member to form a seal, and wherein the sealing material is at least partially disposed between the tubular and at least one of the first and second completion members prior to such movement.

2. The device of claim 1, wherein the device is configured to be deployed downhole.

3. The device of claim 1, wherein the member attains a state when compressed between the first completion member and the second completion member and the member attains a different state when the first completion member and the second completion member do not compress the member.

4. The device of claim 1, wherein the metallic foam is in a pseudoelastic state between about 20 degrees Celsius and about 200 degrees Celsius.

5. The device of claim 1, wherein the member restricts a fluid flow between adjacent regions.

6. The device of claim 5, wherein the member comprises a packing element and the adjacent regions are regions of a wellbore.

7. The device of claim 1, wherein the shape memory alloy has elastic properties that allow bulk compression of about 15% without causing greater than about 8% strain to a portion of the member.

8. The device of claim 1, wherein the member comprises an O-ring.

9. The device of claim 1, wherein the sealing material comprises a polymer that exhibits elastic properties at a temperature range between about 20 degrees Celsius to about 200 degrees Celsius.

10. A device to be deployed downhole, the device comprising:

a member coupled to a production string, the member comprising a metallic foam located on a tubular of the production string configured for fluid flow, the metallic foam made of shape memory alloy having a plurality of gas-filled pores, wherein the metallic foam deforms to a shape that forms the seal and provides support to the seal at a downhole temperature when compressed along the longitudinal axis;

a sealing material covering the metallic foam and filling in the pores of the metallic foam, wherein the sealing material impregnates the pores of the metallic foam as the metallic foam deforms to provide a sealing function of the member; and a first completion member and a second completion member of the production string at opposite ends of the tubular, wherein the first completion member and the second completion member move towards each other to compress the metallic foam along the longitudinal axis to deform the member to form a seal, and wherein the sealing material is at least partially disposed between the tubular and at least one of the first and second completion members prior to such movement.

11. The device of claim 10, wherein the member attains a state when compressed between the first completion member and the second completion member and the member attains a different state when the first completion member and the second completion member do not compress the member.

12. The device of claim 10, wherein the metallic foam is in a pseudoelastic state between about 20 degrees Celsius and about 200 degrees Celsius.

13. The device of claim 10, wherein the member comprises a packing element that separates regions of a wellbore.

14. The device of claim 10, wherein the shape memory alloy has elastic properties that allow bulk compression of about 15% without causing greater than about 8% strain to a portion of the member.

* * * * *